US005415204A

United States Patent [19]

Kitamura

[11] Patent Number: 5,415,204

[45] Date of Patent: May 16, 1995

[54] METHOD OF MANUFACTURING LARGE-DIAMETER SEAMLESS CIRCULAR WOVEN FABRICS

[76] Inventor: Atsushi Kitamura, 30, Izumi-Hommachi 5-chome, Kanazawa-shi, Ishikawa 921, Japan

[21] Appl. No.: 161,087

[22] Filed: Dec. 3, 1993

Related U.S. Application Data

[63] Continuation of Ser. No. 887,820, May 26, 1992, abandoned.

[30] Foreign Application Priority Data

May 27, 1991 [JP] Japan ..... 3-152656

[51] Int. Cl.[6] ..... D03D 3/02

[52] U.S. Cl. ..... 139/55.1; 139/384 R; 139/387 R

[58] Field of Search ..... 139/384 R, 387 R, 387 A, 139/388, 389, 390, 408, 409, 11 R, 383 A, 5, 55.1

[56] References Cited

U.S. PATENT DOCUMENTS 1,062,143 6/1913 Cardot ..... 139/387 R
3,090,406 5/1963 Koppleman et al. ..... 139/410
4,007,763 2/1977 Sellers et al. ..... 139/387 A

FOREIGN PATENT DOCUMENTS 3066347 3/1988 Japan ..... 139/387 R

*Primary Examiner*—Andrew M. Falik
*Attorney, Agent, or Firm*—Armstrong, Westerman, Hattori, McLeland & Naughton

[57] ABSTRACT

A method of weaving a large-diameter seamless cylindrical fabric without piecing together a plurality of unit webs. The method comprises disposing a warp yarn as divided into a first group warp yarn, a second group warp yarn . . . ith group warp yarn . . . and an nth group warp yarn across the width of a weaving loom, inserting a weft in a zigzag fashion turning back at each loom end for each group in succession from the first group warp yarn to the nth group warp yarn and, then, again from the first group warp yarn to the nth group warp yarn to complete one cycle of weft insertion and repeating the same cycle a necessary number of times.

1 Claim, 5 Drawing Sheets

METHOD OF MANUFACTURING LARGE-DIAMETER SEAMLESS CIRCULAR WOVEN FABRICS

This application is a continuation of application Ser. No. 07/887,820, filed May 26, 1992, now abandoned.

FIELD OF THE INVENTION

The present invention relates to a method of manufacturing large-diameter seamless circular-woven fabrics for use as seamless belts and other products.

BACKGROUND OF THE INVENTION

Woven seamless belts for conveyance or power transmission have been used in various segments of the industry. A seamless belt, for instance, is generally manufactured by weaving a cylindrical seamless fabric in the manner of hollow-weave and cutting the fabric in a radial direction.

The diameter of a seamless cylindrical fabric obtainable by such a hollow-weave technique is limited to the breadth of the weaving loom used. Therefore, in order to obtain a cylindrical woven product having a considerably large diameter, such as a seamless belt, it is necessary to sew together a necessary number of unit fabrics into an integral assembly. FIG. 4 is a perspective view showing the conventional large-diameter woven fabric. Indicated at 2*a* is a unit fabric as a constituent member of a large-diameter cylindrical fabric 2, while the seam formed on sewing such unit fabrics together is indicated at 2*b*.

Today, long belts for conveyance or power transmission and, therefore, large-diameter cylindrical woven fabrics are finding application in a diversity of fields. The fabrics for such uses are preferably seamless from the standpoint of product performance but as mentioned above it is difficult to manufacture a large-diameter cylindrical seamless fabric by the conventional hollow-weave technique. For example, even when a seamless cylindrical fabric is woven with a loom having an effective machine width of as great as 2.5 m, the hollow-weave technique may provide a fabric having a circumferential dimension of 5 meters at most.

Therefore, in order to obtain a cylindrical fabric having a very large diameter, it is unavoidable, as aforesaid, to sew up a plurality of unit fabrics together. However, the presence of a seam detracts from the homogeneity of the product fabric and, moreover, the practice involves an additional step of machine sewing and means a commensurate addition to labor cost.

The object of the present invention is to provide a novel weaving technology by which a seamless cylindrical woven fabric having an extremely large diameter can be manufactured in one operation even with a loom of the usual effective machine width.

SUMMARY OF THE INVENTION

The method of weaving a large-diameter seamless cylindrical fabric according to the invention comprises disposing a warp yarn as divided into a first group warp yarn, a second group warp yarn . . . an ith group warp yarn . . . and an nth group warp yarn across the width of a weaving loom, inserting a weft in a zigzag fashion turning back at each loom end for each group in succession from the first group warp yarn to the nth group warp yarn and, then, again in a similar zigzag fashion from the first group warp yarn to the nth group warp yarn to complete one cycle of weft insertion and repeating the same cycle a necessary number of times.

DETAILED DESCRIPTION OF THE INVENTION

Figure 1A:
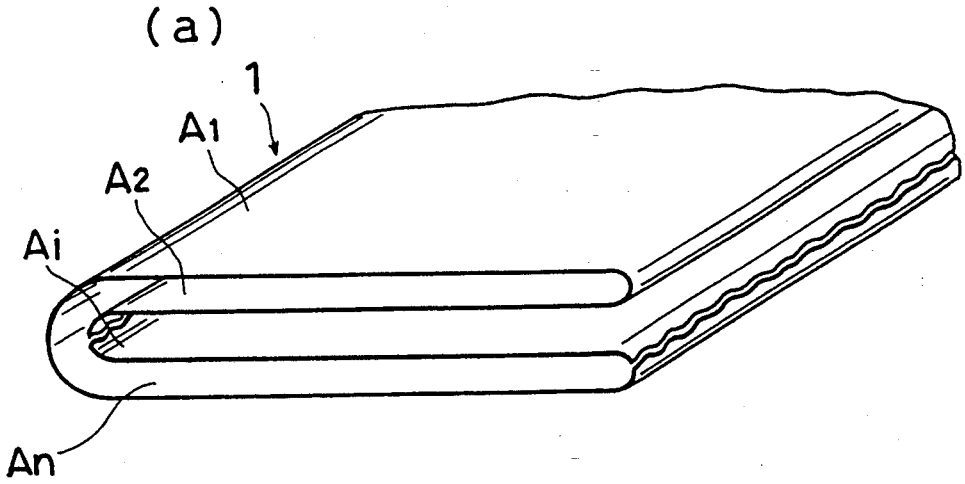
FIG. 1A is a perspective view showing a large-diameter seamless cylindrical fabric as woven by the method of the invention in its condition at the end of weaving.
Figure 1B:
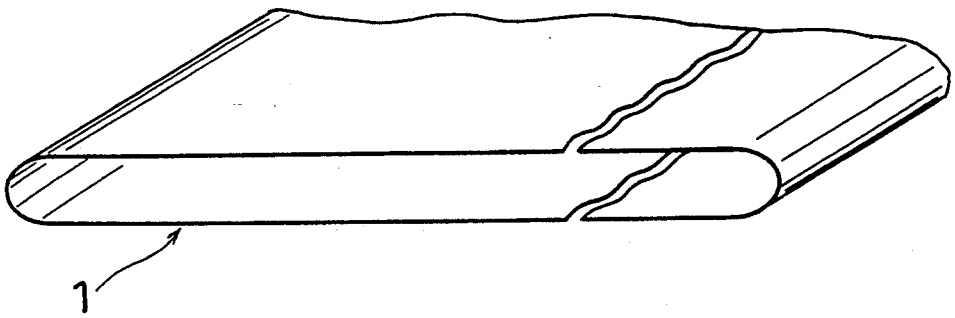
FIG. 1B shows the unfolded condition of the fabric.

Referring to FIGS. 1A and 1B which are schematic views of a large-diameter seamless cylindrical fabric woven by the method of the invention, FIG. 1A represents such fabric at the end of weaving and FIG. 1B represents the unfolded condition of the same fabric.

The method of the present invention begins with distributing warp yarn (H) to be hooked onto harnesses into vertical n groups horizontally across the weaving loom width. Thus, the warp (H) is arranged in vertical n rows horizontally across the machine width as follows.

| |
|---|
| The row of a first group warp $H_{11}$ |
| The row of a second group warp $H_{12}$ |
| — |
| The row of an ith group warp $H_{il}$ |
| — |
| The row of an nth group warp $H_{ni}$ |

In this arrangement, the assemblage of first group warp $H_{11}$ is used for a 1st unit web $L_1$ the assemblage of second group warp $H_{12}$ for a 2nd unit web $L_2$, the assemblage of ith group warp $H_{il}$ for an ith unit web Li and the assemblage of nth group warp $H_{ni}$ for an nth unit web LN.

After completion of this preparatory operation, all the 1st group warp $H_{11}$ yarns are caused to form sheds necessary for picking, with all the other groups of warp yarns being kept in standby condition. The standby condition Step 2 of FIG. 4A) means the condition in which the particular warp does not participate in the weaving process.

In the above condition, insersion of weft or filling (L) is performed. At the turn-back of the weft (L), the 2nd group warp ($H_2$) is shedded and the picking operation is performed through these sheds. During this operation Step 2 of FIG. 4B, too, the other groups of warp (H) are kept in standby condition.

Figures 4A, 4B, 4C, 4D:
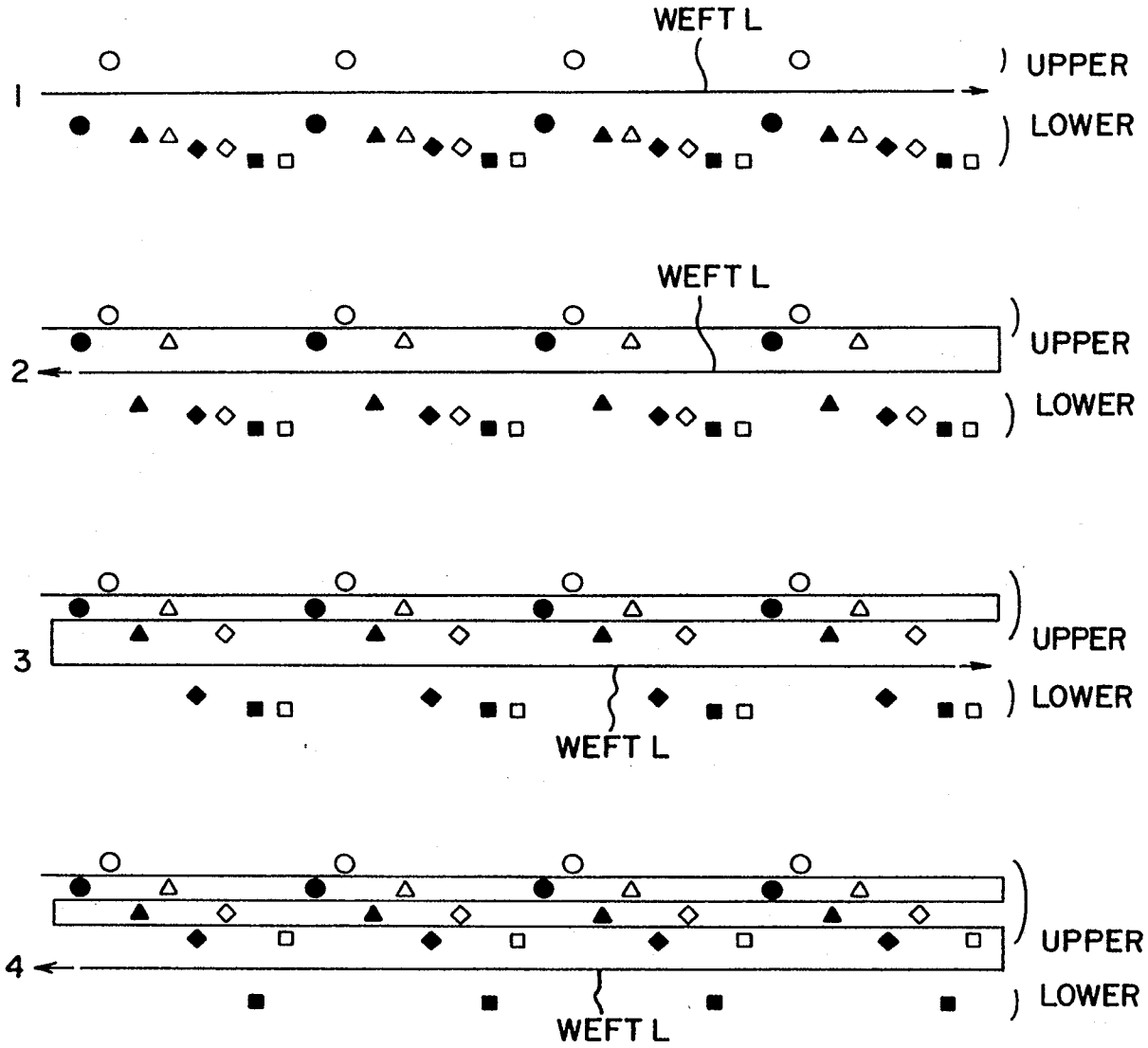
FIGS. 4A–4H are schematic diagrams illustrating sequential steps for the weaving of a large-diameter seamless cylindrical fabric woven by the method of the instant invention.

The picking operation steps 3 and 4 of FIGS. 4C and 4D are performed until the nth group warp (Hn) FIG. 4D has been picked with the same weft (L). After completion of this operation, the zig-zag picking operation is performed again from the 1st group warp ($H_1$) to FIG. 4E to FIG. 4H the nth warp ($H_n$), thus completing one cycle of picking or weft insertion.

By repeating this picking cycle, there is obtained a folded seamless cylindrical fabric 1 as illustrated in FIG. 1A. Unfolding this fabric gives a large-diameter seamless cylindrical woven fabric 1 as illustrated in FIG. 1B.

In this connection, depending on the mode of pairing the weft (L) and the pattern of vertical motion of harnesses, a variety of constructions such as plain-weave, twill-weave and satin-weave can be obtained.

As the warp and weft yarns for weaving a large-diameter seamless cylindrical fabric in accordance with the invention, there may be employed yarns made of various fibrous materials such as polyester fiber, polyamide fiber (inclusive of Aramid fiber), acrylic fiber, polyvinyl alcohol fiber, polyvinylidene chloride fiber, polyvinyl chloride fiber, polyolefin fiber, polyurethane fiber, fluororesin fiber, semi-synthetic fiber, regenerated cellulose fiber, carbon fiber, glass fiber, ceramic fiber, metal fiber and so on.

For the weaving of a large-diameter seamless cylindrical fabric in accordance with the invention, the pattern of vertical motion of harnesses is first designed. This design must be performed in consideration of timing with the insersion of the weft (L).

Thus, when the first group warp ($H_1$) is picked, FIG. 4A, the harnesses carrying the first group warp ($H_1$) are opened and the weft (L) is inserted through the resulting harnesses. After completion of this picking operation, a reed is caused to beat for weaving. During this operation, the other groups of warp (H) are kept in standby condition and not allowed to participate in the weaving process.

Therefore, while the first group warp $H_{11}$ is being picked, this warp is never connected to the other groups of warp (H) so that only the 1st group unit web $L_1$ is woven.

With regard to the next 2nd group warp $H_{21}$. FIG. 4B, the corresponding harnesses only are opened to form sheds and driven vertically in the same manner as above, with the other harnesses being kept in standby condition. In this connection, since the same weft (L) is turned back and inserted, the 1st group warp $H_{11}$ and the 2nd group warp ($H_2$) are connected to each other only at this turn-back position, and the 2nd group unit web, FIG. 4B, only is woven.

Figure 4E:
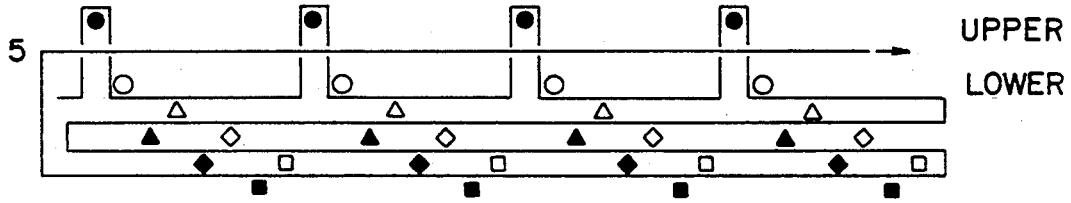
Figure 4F:
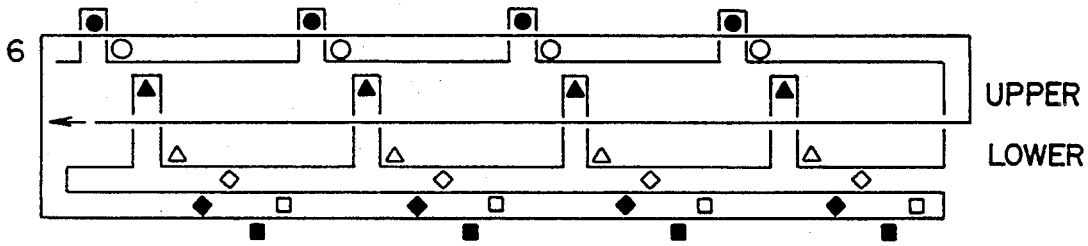
Figure 4G:
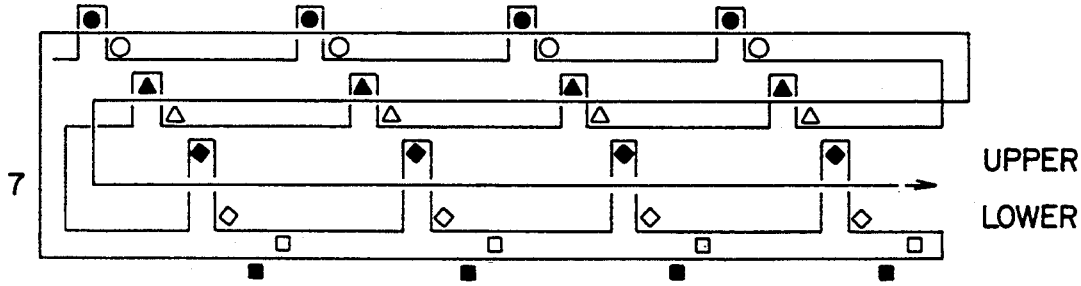
Figure 4H:
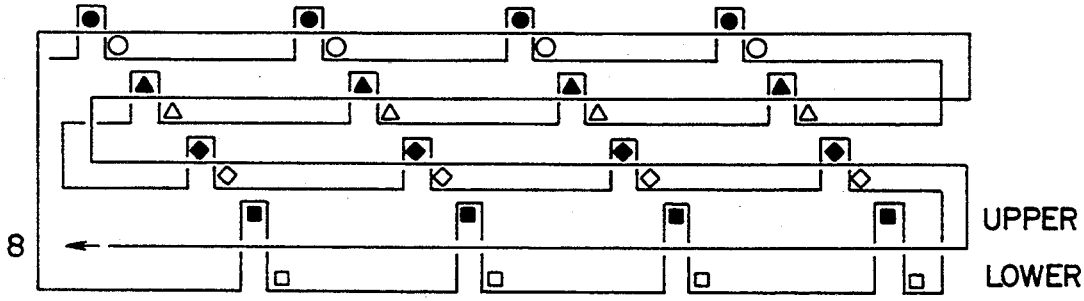

In this manner, the insersion of weft (L) is performed in a zig-zag fashion to the nth group warp $H_{N1}$ and $H_{N2}$ after completion of this operation, FIG. 4B the picking action returns to the 1st group warp $H_{11}$ again and, then, the same operation is repeated from this 1st group warp $H_{11}$, FIG. 4E to the nth group warp $H_{N1}$ and $H_{N2}$, FIG. 4H. The completion of this second insertion of weft (L) through the nth group of warp $H_{N1}$ and $H_{N2}$ means the end of one picking cycle and as this cycle is repeated, a large-diameter seamless cylindrical fabric is ultimately obtained.

Thus, this large-diameter seamless cylindrical woven fabric 1 is obtained as an assembly of the 1st unit web $L_1$, 2nd unit web $L_2$ . . . ith unit web $L_1$ . . . nth unit web LN, 1st unit web $L_1$ . . . connected at the turn-back positions.

The design of such motion of harnesses and of weft (L) is previously programmed by means of a punched card, for instance, and the program is loaded into the weaving loom so that the loom may operate according to that design.

Examples

The following example is further illustrative of the invention.

Figure 2A:
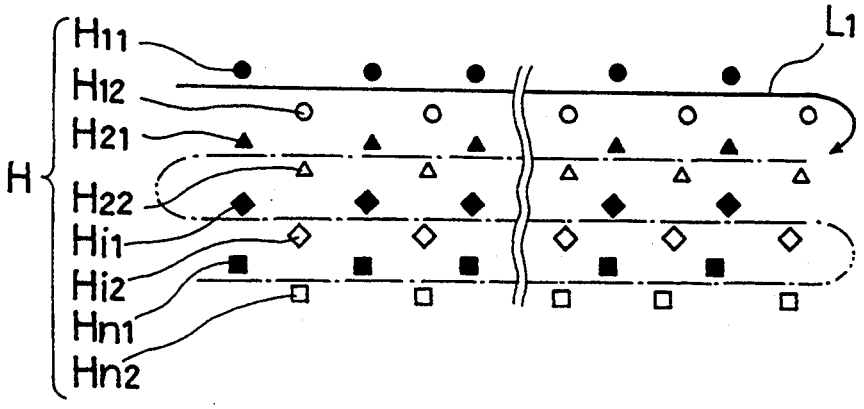
FIG. 2A is a schematic view illustrating the method of weaving large-diameter seamless fabrics in accordance with the invention at the beginning of picking or weft insertion.
Figure 2B:
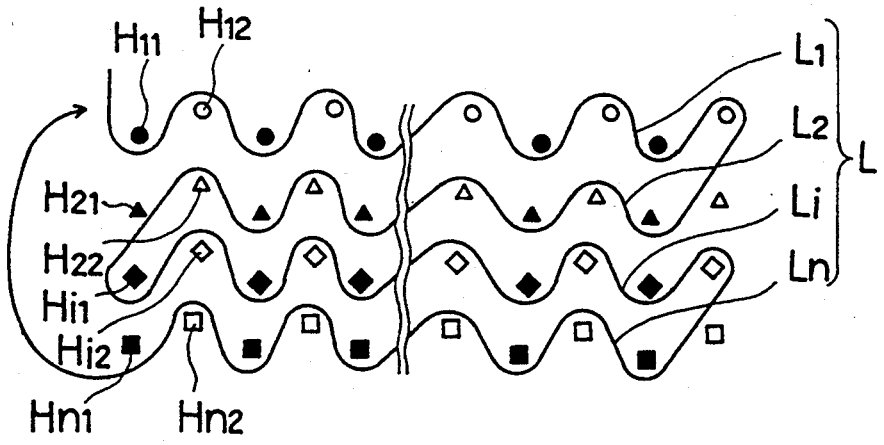
FIG. 2B shows the method of weaving at the end of a half-cycle of picking operation.

The schematic view of FIG. 2 shows the method of weaving a large-diameter seamless fabric in accordance with the invention, where (a) represents the condition at the beginning of picking or weft insersion and (b) represents the condition at completion of a half-cycle of picking.

Figure 3:
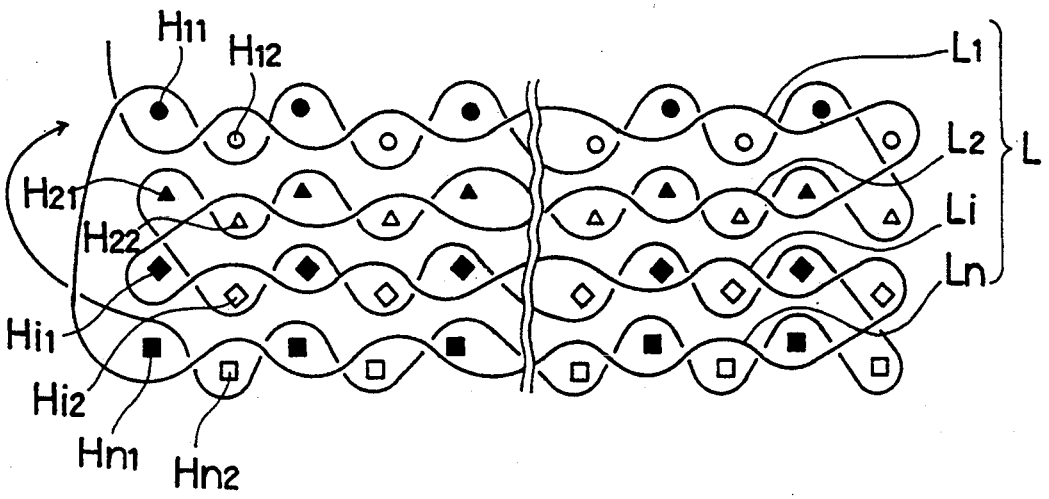
FIG. 3 is a schematic view similar to FIG. 2B, but showing the condition at the end of one full-cycle of picking operation.
Figure 5:
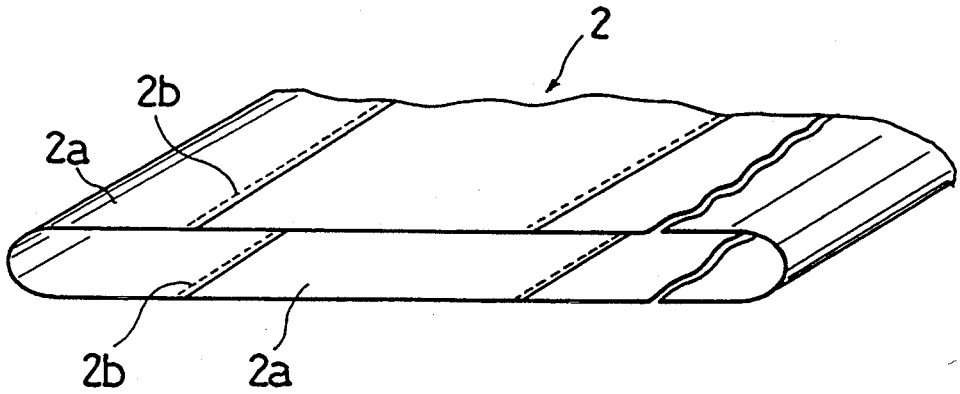
Fig. 5 PRIOR ART
FIG. 5 is a perspective view showing the conventional large-diameter cylindrical woven fabric.

FIG. 3 is a schematic view of the method of weaving large-diameter seamless cylindrical fabrics according to the invention, showing the condition at completion of one cycle of weft insersion.

The warp (H) to be hooked to harnesses on the weaving loom was distributed into n groups of substantially the same number of yarns across the machine width.

Thus, the warp (H) is divided into the first group warp $H_1$ and $H_2$, second group warp $H_{N1}$ and $H_{N2}$ . . . ith group warp ($H_i$) . . . nth group warp ($H_n$), with the unit of each i group warp consisting of a pair of an i group left warp ($H_{i1}$) and an i group right warp ($H_{i2}$). These pairs of warp are vertically set throughout the machine width.

Thus, the whole arrangement is:

| |
|---|
| The pair ($H_{11}$, $H_{12}$) of the first group warp ($H_1$), FIG. 4A, |
| The pair ($H_{21}$, $H_{22}$) of the second group warp ($H_2$), FIG. 4B, |
| — |
| The pair ($H_{i1}$, $H_{i2}$) of the ith group warp (Hi), FIG. 4C, |
| — |
| The pair ($H_{n1}$, $H_{n2}$) of the nth group warp ($H_n$), FIG. 4D. |

A multiplicity of these pairs are arranged across the machine width.

The relative positions of these pairs and the patterns of motion of warp (H) and weft (L) are shown in FIGS. 2A and B, FIG. 3 and FIGS. 4A–H. The circle represents the first group warp ($H_1$), the triangle represents the second group warp ($H_2$), the diamond represents the ith group warp ($H_i$) and the square represents the nth group warp ($H_n$). The closed mark represents the left warp yarn of the corresponding group and the open mark represents the right warp yarn of the corresponding group.

There are four conditions of the harness, namely the open condition forming a shed, the vertically moving condition, the condition during which the reed is beating, and the standby condition, and the harness comes into these conditions in a sequence. The vertical motion of the harness is now explained taking group warp ($H_i$) as an example. When the ith group left warp ($H_{i1}$) is in the raised position and the ith group right warp ($H_{i2}$) in the lowered position with respect to the weft (L), the ith group left warp ($H_{i1}$) moves down and the ith group right warp rises. When the initial relation is reverse, the reverse of the above action takes place.

In the standby condition, the ith group warp ($H_i$) (both the ith group left warp and the ith group right warp) stands by in the position where it does not participate in picking or weft insersion. The warp (H) in this condition is not woven.

In the present invention, the weft (L) is first thrown into the shed formed between the first group left warp ($H_{11}$) and right warp ($H_{12}$) of the first group warp as illustrated in FIG. 2A. Upon completion of this picking, the harness for the first group warp ($H_1$) undergoes a vertical motion to reverse the vertical relation of said first left warp ($H_{11}$) and right warp ($H_{12}$) of the first group warp ($H_1$) and the first group weft ($L_1$) and the first group warp ($H_1$) are interwoven. Beating by the reed ensues and, thereafter, the weft (L) is turned back and inserted into the shed between the second group left warp ($H_{21}$) and second group right warp ($H_{22}$), followed by vertical motion of the second group warp ($H_2$) and beating. This sequence is repeated for the ith group left warp ($H_{i1}$) and ith group right warp ($H_{i2}$) until finally the above picking, vertical motion and beating have been completed for the nth group left warp ($H_{n1}$) and nth group right warp ($H_{n2}$).

The condition after completion of said vertical motion is illustrated in FIG. 2(*b*).

The above actions are now performed again from the first group warp ($H_i$) towards the nth group warp ($H_n$).

When the weft (L) has completed the picking of the last nth group warp ($H_n$) yarn, one cycle of weft insertion is completed. The condition at completion of one cycle is illustrated in FIG. 3. The motion of weft (L) is a zigzag movement from one side of the loom to the other side except at the joint between the first group warp ($H_1$) and nth group at the left end.

As to the weave construction, plain weave is employed in this example to obtain a large-diameter seamless cylindrical fabric consisting of n consecutive unit webs each having a width substantially equal to the loom width.

The present invention is now described in further detail from operation points of view.

In weaving, the warp (H) is first divided into a plurality of stages and passed through the mails (eyes) of harnesses so that sheds may be formed at one time for each group, independently of others.

The vertical motion of the harnesses is set to take place sequentially beginning with the harnesses for the first group warp $H_{11}$ and $H_{12}$ and progressing to those for the second group $H_{21}$ and $H_{22}$, ith group $H_{11}$ and $H_{12}$ and nth group $H_{N1}$ and $H_{N2}$ warps and, then, again from the first group warp $H_{11}$ and $H_{12}$ at the nth group warp ($H_n$), and in timed relation with this motion, the weft (L) is inserted into the sheds formed by the ith group warp $H_{i1}$ and $H_{i2}$. In this operation, the warp yarns (H) of the groups not participating in weft (L) insertion are retained in the standby position.

The above vertical motion of harnesses and insertion of weft are performed according to a punched card program previously supplied to the loom.

In this manner, the weft (L) shuttled into the shed formed by the left warp yarn ($H_{11}$) and right warp yarn ($H_{12}$) of said first group warp ($H_1$) is a first group warp ($L_1$) which forms a first unit web ($A_1$).

Similarly the weft (L) shuttled into the sheds formed by the second group warp $H_2$ is a second group weft ($L_2$) which forms a second unit web ($A_2$). The weft (L) constituting an ith group weft ($L_i$) for the i group warp $H_{i1}$ forms an ith unit web ($A_i$), and the weft (L) constituting an nth group weft $L_{N1}$ forms the nth unit web ($A_n$).

As the above-described reciprocating zigzag motion of weft (L) across the whole loom width is repeated, the first unit web ($A_1$), the second unit web ($A_2$) . . . ith unit web ($A_i$) . . . and nth unit web ($A_n$) are woven but since the entire fabric is woven by the reciprocation of a single weft yarn (L), the respective i unit webs ($A_i$) are interconnected at their turn-back points and the first unit web ($A_1$) and the nth unit web ($A_n$) are connected at the left end so that when the final fabric is spread, its width is as great as the width of each unit web multiplied by n.

In accordance with the weaving method of the invention, even with the-conventional loom of limited machine width, a large-diameter seamless cylindrical fabric having a circumferential dimension equal to n times the machine width can be manufactured in one operation by reciprocation of a weft yarn (L) in a zigzag pattern and it is no longer necessary to sew together a plurality of independent unit webs (2*a*). Therefore, the production process can be drastically rationalized.

What is claimed is:

1. A method for weaving a large-diameter seamless cylindrical woven fabric on a loom comprising disposing a warp yarn from one group of warp yarns divided into first group yarns, second group yarns, ith group yarns and nth group yarns across the width of a weaving loom, inserting a weft yarn in a zigzag direction across said loom width in succeeding alternating opposite directions across each of said first group warp yarns to said nth group warp yarns completing one cycle of weft insertion and repeating the same cycle in the same order until said weaving of said seamless cylindrical woven fabric is completed.

* * * * *